US011227560B2

(12) United States Patent
Chen

(10) Patent No.: US 11,227,560 B2
(45) Date of Patent: Jan. 18, 2022

(54) METHOD FOR DRIVING DISPLAY DEVICE IN A TWO- OR THREE-DIMENSIONAL DISPLAY DEVICE, AND COMPUTER-READABLE STORAGE MEDIUM

(71) Applicants: HKC CORPORATION LIMITED, Guangdong (CN); CHONGQING HKC OPTOELECTRONICS TECHNOLOGY CO., LTD., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 503 days.

(21) Appl. No.: 16/309,055

(22) PCT Filed: Dec. 8, 2017

(86) PCT No.: PCT/CN2017/115221
§ 371 (c)(1),
(2) Date: Dec. 11, 2018

(87) PCT Pub. No.: WO2019/024374
PCT Pub. Date: Feb. 7, 2019

(65) Prior Publication Data

US 2021/0225307 A1 Jul. 22, 2021

(30) Foreign Application Priority Data

Aug. 1, 2017 (CN) ..... 201710655643.3

(51) Int. Cl.
*G09G 3/36* (2006.01)
*G09G 3/00* (2006.01)

(52) U.S. Cl.
CPC ..... *G09G 3/3614* (2013.01); *G09G 3/003* (2013.01); *G09G 3/3659* (2013.01)

(58) Field of Classification Search
None
See application file for complete search history.

(56) References Cited

U.S. PATENT DOCUMENTS 9,336,734 B2 5/2016 Fan et al.
9,524,684 B2 12/2016 Wang
(Continued)

FOREIGN PATENT DOCUMENTS

CN 102201208 9/2011
CN 103151001 6/2013
(Continued)

OTHER PUBLICATIONS

International Search Report for Application No. PCT/CN2017/115221 dated Apr. 26, 2018, 12 pages.

*Primary Examiner* — Kirk W Hermann
(74) *Attorney, Agent, or Firm* — Rosenberg, Klein & Lee

(57) ABSTRACT

A method for driving a display device includes the steps of: when a timer controller controls a display device to enter a three-dimensional display mode from a two-dimensional display mode, switching, by the timer controller, the display device from a two-dimensional display state to a three-dimensional display state and reversing the polarity of a pixel electrode once every N frames when a polarity reversal signal is output where N is a natural number greater than 1.

17 Claims, 8 Drawing Sheets

(56) References Cited

U.S. PATENT DOCUMENTS

| | | | | |
|---|---|---|---|---|
| 9,653,030 | B2 | 5/2017 | Zheng | |
| 2011/0187705 | A1* | 8/2011 | Lan | G06F 3/038 345/419 |
| 2012/0162172 | A1* | 6/2012 | Lee | G09G 3/003 345/209 |
| 2013/0258073 | A1* | 10/2013 | Kozak | H04N 13/398 348/56 |
| 2014/0150045 | A1* | 5/2014 | Mochinaga | H04N 21/23418 725/116 |
| 2014/0225881 | A1* | 8/2014 | Takahashi | G09G 3/3614 345/209 |
| 2015/0109270 | A1* | 4/2015 | Ito | G09G 3/3677 345/207 |

FOREIGN PATENT DOCUMENTS

| | | |
|---|---|---|
| CN | 103761946 | 4/2014 |
| CN | 103941442 | 7/2014 |
| CN | 104464672 | 3/2015 |
| CN | 107393492 | 11/2017 |
| TW | 201227705 | 7/2012 |

* cited by examiner

The natural numbers N and M are continuously changed within a preset range

FIG. 5

The natural number N is adjusted according to a warming state of the display device

FIG. 6

The natural number N is between 2 to 6

FIG. 7

Switching, by the timer controller, the display device from the three-dimensional display state to the two-dimensional display state and reversing the polarity of the pixel electrode once every frame when the polarity reversal signal is output and when the timer controller causes the display device to enter the two-dimensional display mode from the three-dimensional display mode

FIG. 8

METHOD FOR DRIVING DISPLAY DEVICE IN A TWO- OR THREE-DIMENSIONAL DISPLAY DEVICE, AND COMPUTER-READABLE STORAGE MEDIUM

CROSS REFERENCE TO RELATED APPLICATIONS

This is a National Stage application of, and claims priority to, PCT/CN2017/115221, filed Dec. 8, 2017, which claims priority to Chinese Patent Application No. 201710655643.3, filed Aug. 1, 2017, the disclosures of which are incorporated herein by reference in their entirety.

TECHNICAL FIELD

This application relates to a three-dimensional display technology, and particularly relates to a method for driving a display device, a display device, and a computer-readable storage medium.

BACKGROUND

At present, liquid-crystal-display (LCD) 3-dimensional (3D) displays are generally classified into polarized 3D displays and shutter 3D displays. Polarized 3D stereo-imaging technology decomposes an original image using the principle that a light ray has a "vibration direction". Two frames in different polarization directions can be presented to a viewer by placing a polarizing plate on a display screen. When the frames pass through polarized glasses, since either lens of the polarized glasses can only receive a frame in one vibration direction, left and right eyes of a person can receive two groups of frames, which are then synthesized into stereo images in the brain. However, the polarized 3D displays have poor display effects, reduce the brightness of frames, and exhibit a frame sharpness that is half of an original resolution. For example, a 1080p display employing the polarized 3D display technology can only display 540p.

The shutter 3D displays have a simple principle as follows: one frame is displayed to a left eye, at which moment a left lens of 3D glasses is opened and a right lens closed; one frame is displayed to a right eye, at which moment the right lens of the 3D glasses is opened and the left lens closed. In this way, both eyes see different images, which form a 3D effect in the brain.

Generally, image processing approaches of a shutter 3D display can be classified as follows: approach 1: frames are presented in the order of one frame for the left eye and one frame for the right eye with a frame frequency of 120 Hz; approach 2: frames are presented in the order of one frame for the left eye, one black frame, one frame for the right eye, one black frame, and so on with a frame frequency of 240 Hz.

In this way, when a 3D function of a normal LCD is enabled, the problem regarding afterimages may possibly occur. In particular, the problem regarding afterimages is more serious when static images are viewed in a 3D mode.

A brief explanation is given as follows: in the case of viewing a static graphic A in a 3D mode for a long time and then switching to another graphic B, the graphic B should have been displayed in normal cases. However, the effect is actually that the graphic B overlaps a blurred static graphic A, and an afterimage of the static graphic A can be seen. Since the driving of an LCD is generally reversed in the form of column reversal or frame reversal, to be specific, the polarity of a pixel electrode is reversed once every frame, when the static graphic A is viewed in the above approach 1 in the 3D mode, the gray scale of patterns in the static graphic A is actually a mix of white (frame for the left eye) and black (frame for the right eye). When the frame for the left eye is presented, the pixel electrode has a 255-gray-scale positive voltage, and when the frame for the right eye is presented, the pixel electrode has a 0-gray-scale negative voltage. As such, since the pixel polarity deviates greatly from a common electrode VCOM, which causes polarization of liquid crystals, an afterimage occurs in the process of switching to other frames. Similarly, in the process of viewing in the above approach 2 in the 3D mode, afterimages also occur due to polarization of liquid crystals.

SUMMARY

According to various embodiments disclosed in this application, a method for driving a display device, a display device, and a computer-readable storage medium are provided.

A method for driving a display device includes the steps of: when a timer controller controls a display device to enter a three-dimensional display mode from a two-dimensional display mode, switching, by the timer controller, the display device from a two-dimensional display state to a three-dimensional display state and reversing the polarity of a pixel electrode once every N frames when a polarity reversal signal is output, where N is a natural number greater than 1.

By delaying the reversal of polarity, the aforementioned method for driving a display device helps alleviate the problem regarding afterimages as a result of 3D static frames, thus improving 3D viewing effects. Further, since the frequency of reversal is reduced, the power consumption of the display device in the 3D display mode can be reduced.

In one of the embodiments, the method for driving a display device further includes the step of: when the timer controller controls the display device to enter the three-dimensional display mode, reversing, by the timer controller, the polarity of the pixel electrode once every N frames when the polarity reversal signal is output.

In one of the embodiments, when the timer controller controls the display device to keep the three-dimensional display state, the timer controller reverses the polarity of the pixel electrode once every N frames on a timed basis when the polarity reversal signal is output.

In one of the embodiments, N is from 2 to 6.

In one of the embodiments, N is 2 or 4.

In one of the embodiments, the method for driving a display device further includes the steps of: when the timer controller controls the display device to enter the three-dimensional display mode from the two-dimensional display mode, switching, by the timer controller, the display device from the three-dimensional display state to the two-dimensional display state and reversing the polarity of the pixel electrode once every frame when a polarity reversal signal is output.

In one of the embodiments, the method for driving a display device further includes the steps of: determining whether a play mode switch occurs to the display device; if so, further determining whether the switch is a switch from the two-dimensional display mode to the three-dimensional display mode; if so, controlling, by the timer controller, the display device to enter the three-dimensional display mode from the two-dimensional display mode, switching, by the timer controller, the display device from the two-dimensional display state to the three-dimensional display state, and reversing the polarity of the pixel electrode once every N frames when the polarity reversal signal is output.

In one of the embodiments, the method for driving a display device includes the step of presetting a natural number N.

A method for driving a display device includes the steps of: presetting a natural number N1 and a natural number N2, where N1 and N2 are natural numbers greater than 1 and N1 is less than N2; when a timer controller controls a display device to enter a three-dimensional display mode from a two-dimensional display mode, choosing the natural number N1 or the natural number N2 as a natural number N based on a refresh frequency of a three-dimensional display mode, switching, by the timer controller, the display device from a two-dimensional display state to a three-dimensional display state and reversing the polarity of a pixel electrode once every N frames when a polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, switching, by the timer controller, the display device from the three-dimensional display state to the two-dimensional display state, and reversing the polarity of the pixel electrode once every frame when a polarity reversal signal is output.

A display device includes a display controller used to perform any of the aforementioned method for driving a display device.

For example, a display device includes a display controller used to perform a method for driving a display device, where the method for driving a display device includes the steps of: when a timer controller controls a display device to enter a three-dimensional display mode from a two-dimensional display mode, switching, by the timer controller, the display device from a two-dimensional display state to a three-dimensional display state, and reversing the polarity of a pixel electrode once every N frames when a polarity reversal signal is output, where N is a natural number greater than 1.

By delaying the reversal of polarity, the aforementioned display device helps alleviate the problem regarding after-images as a result of 3D static frames, thus improving 3D viewing effects. In addition, since the frequency of reversal is reduced, the power consumption of the display device in the 3D display mode can be reduced.

In one of the embodiments, the method for driving a display device further includes the step of: when the timer controller controls the display device to enter the three-dimensional display mode, reversing, by the timer controller, the polarity of the pixel electrode once every N frames when the polarity reversal signal is output.

In one of the embodiments, in the method for driving a display device, when the timer controller controls the display device to keep the three-dimensional display state, the timer controller reverses the polarity of the pixel electrode once every N frames on a timed basis when the polarity reversal signal is output.

In one of the embodiments, in the method for driving a display device, N is from 2 to 6.

In one of the embodiments, in the method for driving a display device, N is 2 or 4.

In one of the embodiments, the method for driving a display device further includes the steps of: when the timer controller controls the display device to enter the two-dimensional display mode from the three-dimensional display mode, switching, by the timer controller, the display device from the three-dimensional display state to the two-dimensional display state and reversing the polarity of the pixel electrode once every frame when a polarity reversal signal is output.

In one of the embodiments, the method for driving a display device further includes the steps of: determining whether a play mode switch occurs to the display device; if so, further determining whether the switch is a switch from the two-dimensional display mode to the three-dimensional display mode; if so, controlling, by the timer controller, the display device to enter the three-dimensional display mode from the two-dimensional display mode, switching, by the timer controller, the display device from the two-dimensional display state to the three-dimensional display state, and reversing the polarity of the pixel electrode once every N frames when the polarity reversal signal is output.

In one of the embodiments, the method for driving a display device further includes the steps of: presetting a natural number N1 and a natural number N2, where N1 and N2 are natural numbers greater than 1 and N1 is less than N2; when the timer controller controls the display device to enter the three-dimensional display mode from the two-dimensional display mode, choosing the natural number N1 or the natural number N2 as a natural number N based on a refresh frequency of the three-dimensional display mode, switching, by the timer controller, the display device from the two-dimensional display state to the three-dimensional display state, and reversing the polarity of the pixel electrode once every N frames when the polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, switching, by the timer controller, the display device from the three-dimensional display state to the two-dimensional display state and reversing the polarity of the pixel electrode once every frame when the polarity reversal signal is output.

A computer-readable storage medium stores a computer program which, when executed, implements the steps of any of the aforementioned method for driving a display device.

For example, a computer-readable storage medium stores a computer program which, when executed, implements the steps of a method for driving a display device, where the method for driving a display device includes the steps of: when a timer controller controls a display device to enter a three-dimensional display mode from a two-dimensional display mode, switching, by the timer controller, the display device from a two-dimensional display state to a three-dimensional display state, and reversing the polarity of a pixel electrode once every N frames when a polarity reversal signal is output, where N is a natural number greater than 1.

In one of the embodiments, the method for driving a display device further includes the step of: when the timer controller controls the display device to enter the three-dimensional display mode, reversing, by the timer controller, the polarity of the pixel electrode once every N frames when the polarity reversal signal is output.

In one of the embodiments, in the method for driving a display device, when the timer controller controls the display device to keep the three-dimensional display state, the timer controller reverses the polarity of the pixel electrode once every N frames on a timed basis when the polarity reversal signal is output.

In one of the embodiments, in the method for driving a display device, N is from 2 to 6.

In one of the embodiments, in the method for driving a display device, N is 2 or 4.

In one of the embodiments, the method for driving a display device further includes the steps of: when the timer controller controls the display device to enter the two-dimensional display mode from the three-dimensional display mode, switching, by the timer controller, the display device from the three-dimensional display state to the two-dimensional display state and reversing the polarity of the pixel electrode once every frame when a polarity reversal signal is output.

In one of the embodiments, the method for driving a display device further includes the steps of: determining whether a play mode switch occurs to the display device; if so, further determining whether the switch is a switch from the two-dimensional display mode to the three-dimensional display mode; if so, controlling, by the timer controller, the display device to enter the three-dimensional display mode from the two-dimensional display mode, switching, by the timer controller, the display device from the two-dimensional display state to the three-dimensional display state, and reversing the polarity of the pixel electrode once every N frames when the polarity reversal signal is output.

In one of the embodiments, the method for driving a display device further includes the steps of: presetting a natural number N1 and a natural number N2, where N1 and N2 are natural numbers greater than 1 and N1 is less than N2; when the timer controller controls the display device to enter the three-dimensional display mode from the two-dimensional display mode, choosing the natural number N1 or the natural number N2 as a natural number N based on a refresh frequency of the three-dimensional display mode, switching, by the timer controller, the display device from the two-dimensional display state to the three-dimensional display state, and reversing the polarity of the pixel electrode once every N frames when the polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, switching, by the timer controller, the display device from the three-dimensional display state to the two-dimensional display state and reversing the polarity of the pixel electrode once every frame when the polarity reversal signal is output.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

FIG. 5 is a block diagram of the method for driving a display device according to an embodiment.

FIG. 6 is a block diagram of the method for driving a display device according to another embodiment.

FIG. 7 is a block diagram of the method for driving a display device according to a further embodiment.

FIG. 8 is a block diagram of the method for driving a display device according to yet another embodiment.

DETAILED DESCRIPTION OF THE EMBODIMENTS

To make the aforementioned objectives, features, and advantages of this application more comprehensible, the following describes in detail the specific implementations of this application with reference to the accompanying drawings. For ease of understanding of this application, lots of details are described in the following descriptions. However, this application may be implemented by using lots of other manners different from those described herein. Persons skilled in the art may make similar modifications without departing from the content of this application. Therefore, this application is not limited by the specific embodiments disclosed below.

It should be noted that when a component is described to be "fixed on" or "disposed on" another component, the component may be directly on another component, or there may be an intermediate component. When a component is described to be "connected to" another component, the component may be directly connected to another component, or there may be an intermediate component. Terms such as "perpendicular", "horizontal", "left", "right" and similar expressions adopted in the specification are only for description purposes and do not represent an only implementation.

Unless otherwise defined, all technical and scientific terms used herein have the same meaning as commonly understood by persons of ordinary skill in the art to which this application belongs. Terms used in this specification are only for descriptions of specific implementations instead of limiting this application. The term "and/or" used herein includes any or all possible combinations of one or more associated listed items.

Figure 1:
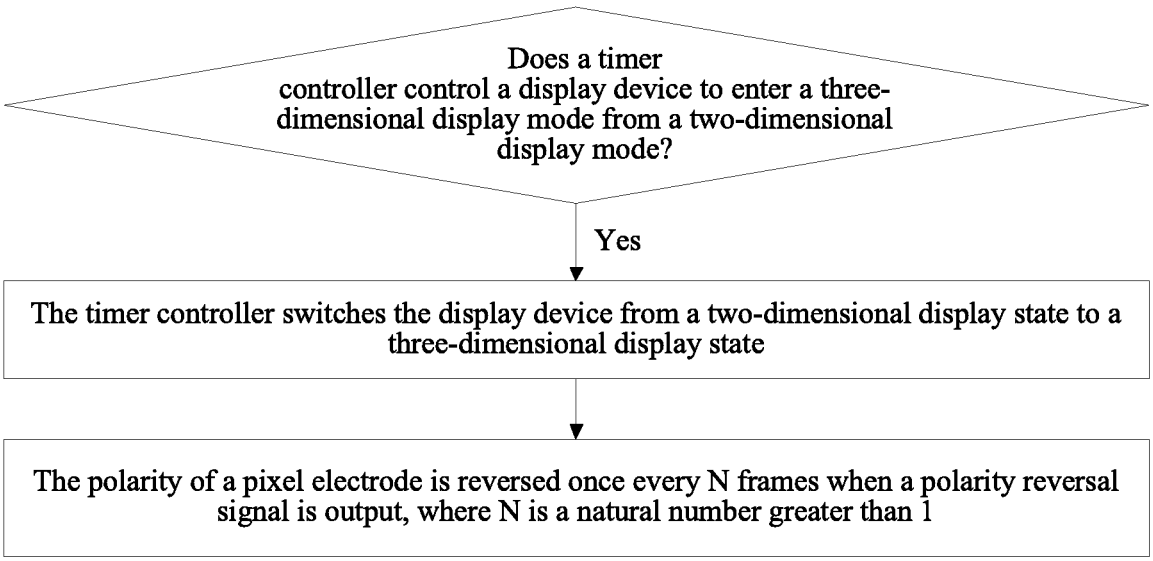
FIG. 1 is a flowchart of a method for driving a display device according to an embodiment.

A method for driving a display device according to one embodiment of this disclosure includes the steps that when the timer controller controls the display device to enter a three-dimensional display mode from a two-dimensional display mode, the display device is switched by a timer controller (TCON) from a two-dimensional display state to a three-dimensional display state, and the polarity of a pixel electrode is reversed once every N frames, when a polarity reversal signal is output. N is a natural number greater than 1 For example, a method for driving a display device includes the steps that a three-dimensional display mode is enabled; a switching approach of the three-dimensional display mode is acquired, the switching approach includes reversing the polarity of a pixel electrode once every N frames, where N is a natural number greater than 1; and a display device is switched by a timer controller to the three-dimensional display mode according to the switching approach. In this way, by controlling reversal of driving of 2D and 3D modes through a TCON, the problem regarding afterimages in the 3D mode is alleviated, picture quality is improved, and power consumption of an LCD in a 3D mode is also reduced. The power consumption is related to a frequency of reversal, and a higher frequency of reversal indicates higher power consumption. By delaying the reversal of polarity, the aforementioned method for driving a display device helps alleviate the problem regarding afterimages as a result of 3D static frames, thus improving 3D viewing effects. Further, since the frequency of reversal is reduced, the power consumption of the display device in the 3D display mode can be reduced. For example, as shown in FIG. 1, a method for driving a display device includes the steps that when a timer controller controls a display device to enter a three-dimensional display mode from a two-dimensional display mode, the display device is switched by the timer controller from a two-dimensional display state to a three-dimensional display state, and when a polarity reversal signal is output, the polarity of a pixel electrode is reversed once every N frames, where N is a natural number greater than 1 For example, a method for driving a display device includes the step that when a timer controller of a display device controls a switch from a two-dimensional display mode to a three-dimensional display mode, the polarity of a pixel electrode is reversed once every N frames, where N is a natural number greater than 1. A method for driving a display device according to one embodiment of this disclosure includes the steps that a natural number N is preset, where N is greater than 1; a three-dimensional display mode is enabled; a switching approach of the three-dimensional display mode is acquired, where the switching approach includes reversing the polarity of a pixel electrode once every N frames; and a display device is switched by a timer controller to the three-dimensional display mode according to the switching approach. For example, when the two-dimensional display mode is switched to the three-dimensional display mode, the timer controller reverses the polarity of the pixel electrode once every N frames. As such, by delaying the reversal of polarity, the method helps alleviate the problem regarding afterimages as a result of 3D static frames, thus improving 3D viewing effects. In one of the embodiments, as shown in FIG. 7, N is from 2 to 6. In one of the embodiments, N is 2 or 4. For example, N is 2, 3 or 4. It should be understood that when N is 2, the frequency of reversal of polarity is 50% of an original frequency, and when N is 3, the frequency of reversal of polarity is 33% of the original frequency, and as such, liquid crystals are not easily polarized, thus avoiding generation of afterimages, which improves user viewing experience. For example, when a 3D function is enabled, the approach of reversal of driving is changed from reversing the polarity once every frame to reversing the polarity once every 2 frames or 4 frames. In this way, even in a 3D mode, the voltage of the pixel electrode can be balanced relative to VCOM without polarization of liquid crystals, thus avoiding generation of afterimages. Further, since the frequency of reversal is reduced, the power consumption of the display device in the 3D display mode can be reduced.

To better adapt to the development of technologies, for example, the natural number N is preset or set based on a refresh frequency of the three-dimensional display mode of the display device, that is, a natural number N greater than 1 can be set based on the refresh frequency of the three-dimensional display mode. In this way, when the refresh frequency of the three-dimensional display mode is increased, the natural number N can be changed accordingly. For example, the frame frequency is 120 Hz or 240 Hz, which correspond to different natural numbers N. For another example, the natural number N is preset based on the refresh frequency of the three-dimensional display mode, where N is in direct proportion to the refresh frequency and is rounded, for example, rounded off, rounded up, or rounded down. For yet another example, a ratio for the direct proportion is set according to an empirical value or is adjusted as needed. For example, the ratio for the direct proportion is preset at the time of delivery. For another example, in order to adapt to the 3D display frequency, the rounding is rounding down, for example, 6.9 is rounded down to 6, and so on. The design of rounding down helps limit the natural number N when the refresh frequency of the three-dimensional display mode does not exceed a limit value and decrease the possibility that a liquid crystal is polarized while ensuring that the display device properly displays a three-dimensional frame, thus delaying the time of a user's visual transition and further avoiding the occurrence of an afterimage effect. For example, a higher refresh frequency indicates a greater natural number N, and a lower refresh frequency indicates a smaller natural number N. In this way, the power consumption of an LCD in a 3D mode can be effectively reduced.

Figure 2:
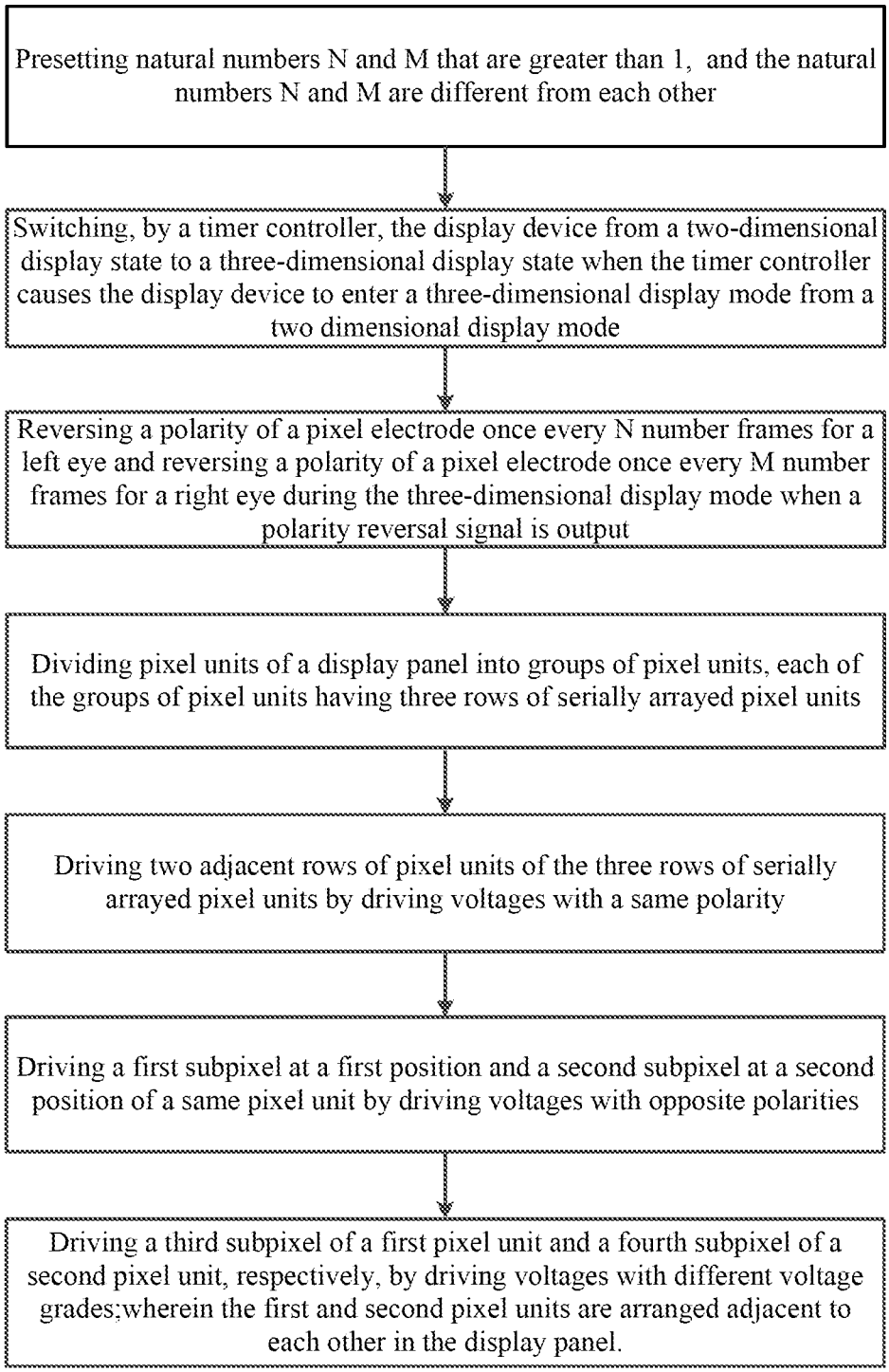
FIG. 2 is a flowchart of a method for driving a display device according to another embodiment.

According to another embodiment, in a method for driving a display device, visions of left and right eyes are the same or different. For another example, a natural number N greater than 1 is preset, where N includes N1 and N2. During a three-dimensional display mode, including a switch from a two-dimensional display to the three-dimensional display or entry into the three-dimensional display, the polarity of the pixel electrode is reversed once every N1 frames for the left eye and the polarity of the pixel electrode is reversed once every N2 frames for the right eye. N1 and N2 are set to be the same or different. In this way, for an intention to present a three-dimensional image with a special effect, a new presentation effect that is significantly different from that of a traditional 3D presentation mode can be made, for example, fewer even no afterimages are presented to the left eye, and more afterimages are presented to the right eye, thus creating an enough difference between the two eyes and further obtaining a display effect that is greatly different from the traditional 3D display mode. For example, as shown in FIG. 2, a method for driving a display device includes the steps that natural numbers N and M that are greater than 1 are preset, where N and M are set to be the same or different; the polarity of a pixel electrode is reversed once every N frames for the left eye and the polarity of the pixel electrode is reversed once every M frames for the right eye during a three-dimensional display mode. The rest is deduced by analogy. For another example, N is constantly changed, that is, N1 and N2 are constantly changed. For example, N1 and N2 or N and M are constantly changed within a preset range (as shown in FIG. 5), thus creating a new presentation effect. For example, no afterimage is presented to the left eye and an afterimage is occasionally presented to the right eye. In this way, a play effect in which afterimages are different is provided for a user by using different source images, thus realizing 3D frame display in which both eyes are in different states. In addition, 3D static frame display is under way, which eliminates the problem regarding afterimages. Moreover, an additional three-dimensional display effect is realized by using the difference in afterimages.

In one of the embodiments, the driving method further includes the steps that when the timer controller controls the display device to enter the three-dimensional display mode, the polarity of the pixel electrode is reversed by the timer controller once every N frames when a polarity reversal signal is output; and/or when the timer controller controls the display device to keep three-dimensional display, the polarity of the pixel electrode is reversing by the timer controller once every N frames on a timed basis when the polarity reversal signal is output, for example, the polarity of the pixel electrode is reversed once every N frames on a timed basis. In this way, the polarity of the pixel electrode is directly set to be reversed once every N frames during the three-dimensional display mode; the polarity of the pixel electrode is directly set to be reversed once every N frames after switched to the three-dimensional display mode; and the polarity of the pixel electrode is set to be reversed once every N frames on a timed basis during the three-dimensional display mode. In this way, by setting the polarity of the pixel electrode to be reversed once every N frames on a timed basis, possible interferences caused by other procedures can be avoided. In one embodiment, during the three-dimensional display, the polarity of the pixel electrode is reversed once every N frames on a timed basis, where the value of N is adjusted according to a frequency of the three-dimensional display and/or a warming state of the display device (as shown in FIG. 6). For example, N is in direct proportion to the warming state of the display device and is rounded. For another example, N is in direct proportion to a warming state of a predetermined position of the display device and is rounded. In this way, the frequency of reversal of driving is changed to improve the warming state of the display device when the display device is subjected to local overheating, thus increasing the service life of the display device. According to one embodiment, a method for driving a display device includes the steps that a natural number N is preset according to a frequency of a three-dimensional display mode during the three-dimensional display mode, where N is greater than 1; and the polarity of a pixel electrode is reversed once every N frames. That is, the natural number N can be preset prior to the three-dimensional display, and the natural number N can be set during the three-dimensional display or after the three-dimensional display.

In one of the embodiments, as shown in FIG. 8, the method for driving a display device further includes the steps that when the timer controller controls the display device to enter the two-dimensional display mode from the three-dimensional display mode, the display device is switched by the timer controller from the three-dimensional display state to the two-dimensional display state and the polarity of the pixel electrode is reversed once every frame when the polarity reversal signal is output. In one of the embodiments, the method for driving a display device specifically includes the steps that whether a play mode switch occurs to the display device is determined; if so, whether the switch is a switch from the two-dimensional display mode to the three-dimensional display mode is further determined; if so, the display device is controlled by the timer controller to enter the three-dimensional display mode from the two-dimensional display mode, the display device is switching by the timer controller from the two-dimensional display state to the three-dimensional display state, and the polarity of the pixel electrode is reversed once every N frames when the polarity reversal signal is output. For example, when the three-dimensional display mode is switched to the two-dimensional display mode, the polarity of the pixel electrode is reversed once every frame. For example, a method for driving a display device includes the steps that a natural number N is preset, where N is greater than 1; the polarity of a pixel electrode is reversed by a timer controller once every N frames during a three-dimensional display mode; and the polarity of the pixel electrode is reversed by the timer controller once every frame during a two-dimensional display mode. In one of the embodiments, the method for driving a display device specifically includes the steps that the polarity of the pixel electrode is reversed by the timer controller once every N frames when a switch from the two-dimensional display mode to the three-dimensional display mode is determined in case of a play mode switch; and the polarity of the pixel electrode is reversed by the timer controller once every frame when a switch from the three-dimensional display mode to the two-dimensional display mode is determined. For example, the method for driving a display device specifically includes the steps that the natural number N is preset; the polarity of the pixel electrode is reversed once every N frames when a switch from the two-dimensional display to the three-dimensional display is determined in case of a play mode switch; and the polarity of the pixel electrode is reversed once every frame when a switch from the three-dimensional display to the two-dimensional display is determined. In this way, by controlling reversal of driving of 2D and 3D modes through a TCON, the problem regarding afterimages in the 3D mode is alleviated, frame quality is improved, and power consumption of an LCD in the 3D mode is also reduced. The power consumption is related to a frequency of reversal, and a higher frequency of reversal indicates higher power consumption.

Figure 3:
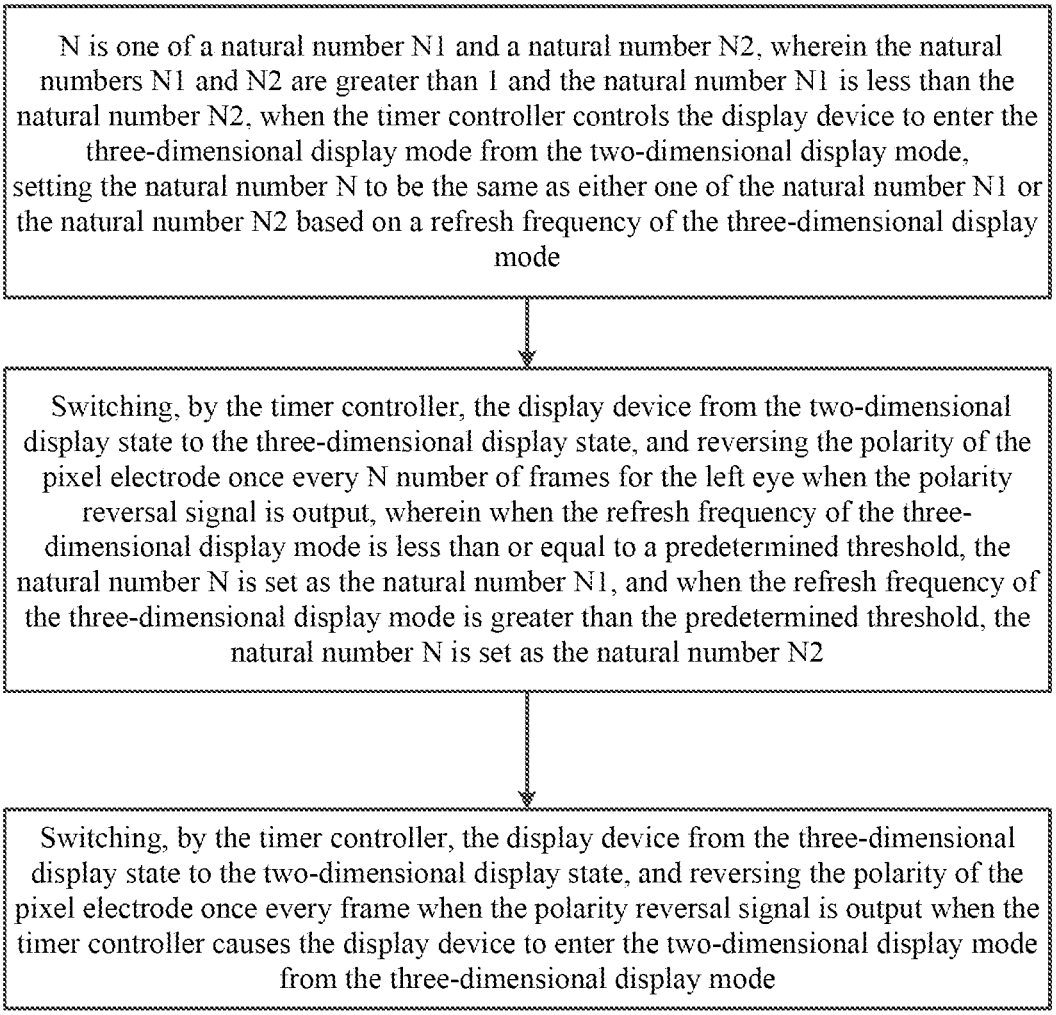
FIG. 3 is a flowchart of a method for driving a display device according to a further embodiment.

For example, as shown in FIG. 3, a method for driving a display device includes the steps that a natural number N1 and a natural number N2 are preset, where N1 and N2 are natural numbers greater than 1 and N1 is less than N2; when a timer controller controls a display device to enter a three-dimensional display mode from a two-dimensional display mode, the natural number N1 or the natural number N2 is chosen as a natural number N based on a refresh frequency of the three-dimensional display mode, the display device is switched by a timer controller from a two-dimensional display state to a three-dimensional display state, and the polarity of a pixel electrode is reversed once every N frames when a polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, the display device is switched by the timer controller from the three-dimensional display state to the two-dimensional display state, and the polarity of the pixel electrode is reversed once every frame when a polarity reversal signal is output.

In one of the embodiments, in the 2D mode at ordinary times, the TCON employs a normal driving mode of column reversal or frame reversal; when it is necessary to enter the 3D mode upon receiving of a 3D enable signal, in addition to switching frame processing to a 3D state, the TCON also switches the mode of reversal of polarity.

For example, when the 3D mode is a mode in which frames are presented in the order of one frame for the left eye and one frame for the right eye, for example, when the refresh frequency is 120 Hz, a signal output by the TCON for controlling reversal of polarity of a pixel voltage is changed from reversing once every frame to reversing once every two frames. In this way, the polarity of the frame for the left eye and the polarity of the frame for the right eye are also constantly changed, rather than always in one polarity, thus avoiding afterimages resulting from viewing static pictures in the 3D mode.

For another example, when the 3D mode is a mode in which frames are presented in the order of one frame for the left eye, one black frame, one frame for the right eye, and one black frame, and so on, for example, when the refresh frequency is 240 Hz, a signal output by the TCON for controlling reversal of polarity of a pixel voltage is changed from reversing once every frame to reversing once every four frames. In this way, the polarity of the frame for the left eye and the polarity of the frame for the right eye are also constantly changed, rather than always in one polarity, thus avoiding afterimages resulting from viewing static pictures in the 3D mode.

When the 3D enable signal ends and the 2D mode restarts, the TCON switches the polarity reversal signal to reversing once every frame, so as not to affect the display effect of 2D frames.

As such, the problem regarding afterimages as a result of viewing 3D static pictures can be alleviated without affecting normal display of the 2D mode, thus improving 3D viewing effects.

For another example, as shown in FIG. 2, during the two-dimensional display mode or the three-dimensional display mode, the method further includes the steps that a plurality of pixel units of a display panel are divided into several groups of pixel units, each of the groups of pixel units includes three rows of serially arrayed pixel units; two adjacent rows of pixel units of the three rows of serially arrayed pixel units are driven by driving voltages with the same polarity; a subpixel at a first position and a subpixel at a second position of the same pixel unit are driven by driving voltages with opposite polarities; a subpixel of a first pixel unit and a subpixel of a second pixel unit are respectively driven by driving voltages with different voltage grades, where the first pixel unit and the second pixel unit are arranged adjacent to each other in the display panel. For example, the display panel has a plurality of pixel units distributed in a matrix. For example, the display panel has several first pixel units and several second pixel units which are arranged adjacent to each other. In addition, each of the pixel units includes a plurality of subpixels. For example, each pixel unit includes at least a red subpixel, a green subpixel, and a blue subpixel. Optionally, each pixel unit can further include a white subpixel. For example, the three rows of serially arrayed pixel units are successively pixel units at a first position, pixel units at a second position, and pixel units at a third position in an arraying order. The step that the two adjacent rows of pixel units of the three rows of serially arrayed pixel units are driven by driving voltages with the same polarity includes that the pixel units at the second position and the pixel units at the third position are respectively driven by driving voltages with the same polarity. For example, the step that the two adjacent rows of pixel units of the three rows of serially arrayed pixel units are driven by driving voltages with the same polarity further includes that the pixel units at the first position and the pixel units at the second position are respectively driven by driving voltages with opposite polarities. For example, each of the pixel units includes a first subpixel, a second subpixel, a third subpixel, and a fourth subpixel arrayed in order; the step that the subpixel at the first position and the subpixel at the second position of the same pixel unit are driven by driving voltages with opposite polarities includes that the first subpixel and the second subpixel of the same pixel unit are driven by driving voltages with opposite polarities; the fourth subpixel of the same pixel unit is driven by a driving voltage with the same polarity as the first subpixel; and the third subpixel of the same pixel unit is driven by a driving voltage with the same polarity as the second subpixel. For example, the driving method further includes that the same subpixel is driven by driving voltages with opposite polarities within the time of displaying every two adjacent frames. As such, it is possible that the number of subpixels in each column to which a driving voltage of a high voltage grade with a positive polarity is applied is equal to the number of subpixels to which a driving voltage of a high voltage grade with a negative polarity is applied, such that the VCOM voltage is protected from a parasitic capacitance, thus ensuring the correctness of an image signal and avoiding color shifts or abnormal frame quality.

In yet another embodiment of this application, provided is a display method, which includes the method for driving a display device of any of the preceding embodiments. The display method further includes the step of displaying an image, where for example, the image includes a static graphic and/or a dynamic image. For example, a display method includes the steps of the method for driving a display device of any of the preceding embodiments; and displaying an image. For example, a display method includes the steps that a natural number N is preset, where N is greater than 1; an image is displayed; and the polarity of a pixel electrode is reversed once every N frames during a three-dimensional display mode. For example, a display method includes the steps that a natural number N is preset, where N is greater than 1; an image is displayed; the polarity of a pixel electrode is reversed once every N frames during a three-dimensional display mode; and the polarity of the pixel electrode is reversed once every frame during a two-dimensional display mode. For example, a display method includes the steps that a natural number N is preset, where N is greater than 1; an image is displayed; whether a two-dimensional display mode is performed is determined, and if so, the polarity of a pixel electrode is reversed once every frame, and if not, whether a three-dimensional display mode is performed is determined, and if so, the polarity of the pixel electrode is reversed once every N frames; whether a display mode switch is a switch from the two-dimensional display mode to the three-dimensional display mode is determined each time the display mode switch occurs, and if so, the polarity of the pixel electrode is reversed once every N frames; and whether it is a switch from the three-dimensional display mode to the two-dimensional display mode is determined, and if so, the polarity of the pixel electrode is reversed once every frame. By delaying the reversal of polarity, the aforementioned display method helps alleviate the problem regarding afterimages as a result of 3D static frames, thus improving 3D viewing effects. In one of the embodiments, in the process of displaying an image, the method for driving a display device of any of the preceding embodiments is performed. In one of the embodiments, when displaying of the image starts, the method for driving a display device of any of the preceding embodiments is performed.

Figure 4:
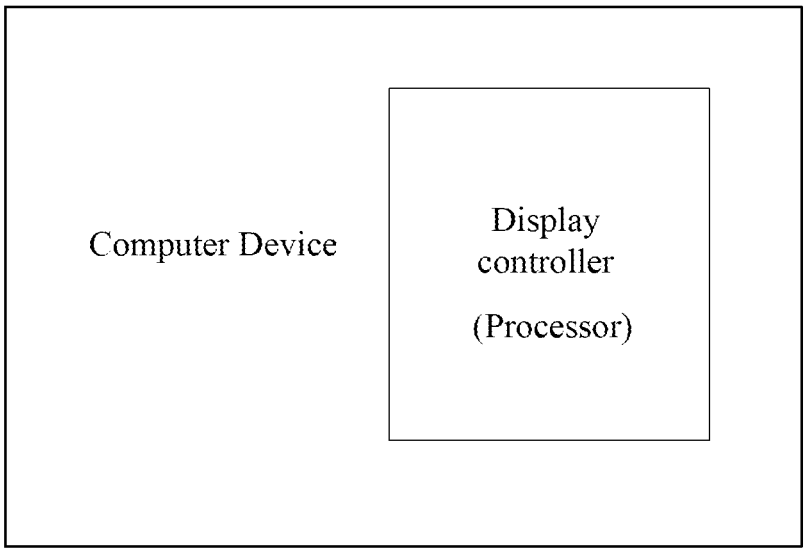
FIG. 4 is a diagram of a display device according to an embodiment.

In another embodiment of this application, provided is a display device, as shown in FIG. 4, which includes a display controller used to perform the method for driving a display device of any of the preceding embodiments. For another example, a display device includes a display controller used to perform the display method of any of the preceding embodiments.

For example, a display device includes a display controller used to perform a method for driving a display device, where the method for driving a display device includes the steps that when the timer controller controls the display device to enter a three-dimensional display mode from a two-dimensional display mode, the display device is switched by the timer controller from a two-dimensional display state to a three-dimensional display state, and the polarity of a pixel electrode is reversed once every N frames when a polarity reversal signal is output, where N is a natural number greater than 1.

In one of the embodiments, the method for driving a display device further includes the step that when the timer controller controls the display device to enter the three-dimensional display mode, the polarity of the pixel electrode is reversed by the timer controller once every N frames when the polarity reversal signal is output.

In one of the embodiments, in the method for driving a display device, when the timer controller controls the display device to keep the three-dimensional display state, the timer controller reverses the polarity of the pixel electrode once every N frames on a timed basis when the polarity reversal signal is output.

In one of the embodiments, in the method for driving a display device, N is from 2 to 6.

In one of the embodiments, in the method for driving a display device, N is 2 or 4.

In one of the embodiments, the method for driving a display device further includes the steps that when the timer controller controls the display device to enter the two-dimensional display mode from the three-dimensional display mode, the display device is switched by the timer controller from the three-dimensional display state to the two-dimensional display state, and the polarity of the pixel electrode is reversed once every frame when a polarity reversal signal is output.

In one of the embodiments, the method for driving a display device further includes the steps that whether a play mode switch occurs to the display device is determined; if so, whether the switch is a switch from the two-dimensional display mode to the three-dimensional display mode is further determined; if so, the display device is controlled by the timer controller to enter the three-dimensional display mode from the two-dimensional display mode, the display device is switched by the timer controller from the two-dimensional display state to the three-dimensional display state, and the polarity of the pixel electrode is reversed once every N frames when the polarity reversal signal is output.

In one of the embodiments, the method for driving a display device further includes the steps that a natural number N1 and a natural number N2 are preset, where N1 and N2 are natural numbers greater than 1 and N1 is less than N2; when the timer controller controls the display device to enter the three-dimensional display mode from the two-dimensional display mode, the natural number N1 or the natural number N2 is chosen as a natural number N based on a refresh frequency of the three-dimensional display mode, the display device is switched by the timer controller from the two-dimensional display state to the three-dimensional display state, and the polarity of the pixel electrode is reversed once every N frames when the polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, the display device is switched by the timer controller from the three-dimensional display state to the two-dimensional display state, and the polarity of the pixel electrode is reversed once every frame when the polarity reversal signal is output.

In yet another embodiment of this application, provided is a computer-readable storage medium storing a computer program which, when executed, implements the steps of the method for driving a display device of any of the preceding embodiments. For example, in the computer-readable storage medium, the computer program, when executed, implements part or all of the steps of the driving method of any of the preceding embodiments.

For example, a computer-readable storage medium stores a computer program which, when executed, implements the steps of a method for driving a display device, where the method for driving a display device includes the steps that when a timer controller controls a display device to enter a three-dimensional display mode from a two-dimensional display mode, the display device is switched by the timer controller from a two-dimensional display state to a three-dimensional display state, and the polarity of a pixel electrode is reversed once every N frames when a polarity reversal signal is output, where N is a natural number greater than 1.

In one of the embodiments, the method for driving a display device further includes the step that when the timer controller controls the display device to enter the three-dimensional display mode, the polarity of the pixel electrode is reversed by the timer controller once every N frames when the polarity reversal signal is output.

In one of the embodiments, in the method for driving a display device, when the timer controller controls the display device to keep the three-dimensional display state, the timer controller reverses the polarity of the pixel electrode once every N frames on a timed basis when the polarity reversal signal is output.

In one of the embodiments, in the method for driving a display device, N is from 2 to 6.

In one of the embodiments, in the method for driving a display device, N is 2 or 4.

In one of the embodiments, the method for driving a display device further includes the steps that when the timer controller controls the display device to enter the two-dimensional display mode from the three-dimensional display mode, the display device is switched by the timer controller from the three-dimensional display state to the two-dimensional display state, and the polarity of the pixel electrode is reversed once every frame when a polarity reversal signal is output.

In one of the embodiments, the method for driving a display device further includes the steps that whether a play mode switch occurs to the display device is determined; if so, whether the switch is a switch from the two-dimensional display mode to the three-dimensional display mode is further determined; if so, the display device is controlled by the timer controller to enter the three-dimensional display mode from the two-dimensional display mode, the display device is switched by the timer controller from the two-dimensional display state to the three-dimensional display state, and the polarity of the pixel electrode is reversed once every N frames when the polarity reversal signal is output.

In one of the embodiments, the method for driving a display device further includes the steps that a natural number N1 and a natural number N2 are preset, where N1 and N2 are natural numbers greater than 1 and N1 is less than N2; when the timer controller controls the display device to enter the three-dimensional display mode from the two-dimensional display mode, the natural number N1 or the natural number N2 is chosen as a natural number N based on a refresh frequency of the three-dimensional display mode, the display device is switched by the timer controller from the two-dimensional display state to the three-dimensional display state, and the polarity of the pixel electrode is reversed once every N frames when the polarity reversal signal is output, where when the refresh frequency of the three-dimensional display mode is less than or equal to a predetermined threshold, the natural number N1 is chosen as the natural number N, and when the refresh frequency of the three-dimensional display mode is greater than the predetermined threshold, the natural number N2 is chosen as the natural number N; and when the timer controller controls the display device to enter the two-dimensional display mode from the three-dimensional display mode, the display device is switched by the timer controller from the three-dimensional display state to the two-dimensional display state, and the polarity of the pixel electrode is reversed once every frame when the polarity reversal signal is output.

Various technical features in the foregoing embodiments may be combined randomly. For ease of description, possible combinations of various technical features in the foregoing embodiments are not all described. However, the combinations of the technical features should be considered as falling within the scope recorded in this specification provided that the combinations of the technical features are compatible with each other.

The foregoing embodiments only describe several implementations of this application, which are described specifically and in detail, and therefore cannot be construed as a limitation to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

What is claimed is:

1. A method for driving a display device, comprising:

presetting natural numbers N and M that are greater than 1, wherein the natural numbers N and M are different from each other;

switching, by a timer controller, the display device from a two-dimensional display state to a three-dimensional display state when the timer controller causes the display device to enter a three-dimensional display mode from a two dimensional display mode;

reversing a polarity of a pixel electrode once every N number frames for a left eye and reversing a polarity of a pixel electrode once every M number frames for a right eye during the three-dimensional display mode when a polarity reversal signal is output;

dividing pixel units of a display panel into groups of pixel units, each of the groups of pixel units having three rows of serially arrayed pixel units;

driving two adjacent rows of pixel units of the three rows of serially arrayed pixel units by driving voltages with a same polarity;

driving a first subpixel at a first position and a second subpixel at a second position of a same pixel unit by driving voltages with opposite polarities; and driving a third subpixel of a first pixel unit and a fourth subpixel of a second pixel unit, respectively, by driving voltages with different voltage grades;

wherein the first and second pixel units are arranged adjacent to each other in the display panel.

2. The method for driving the display device according to claim 1, wherein the natural numbers N and M are continuously changed within a preset range.

3. The method for driving the display device according to claim 1, wherein the natural number N is adjusted according to a warming state of the display device.

4. The method for driving the display device according to claim 1, wherein the natural number N is between 2 to 6.

5. The method for driving the display device according to claim 1, further comprising: switching, by the timer controller, the display device from the three-dimensional display state to the two-dimensional display state and reversing the polarity of the pixel electrode once every frame when the polarity reversal signal is output and when the timer controller causes the display device to enter the two-dimensional display mode from the three-dimensional display mode.

6. The method for driving the display device according to claim 1, wherein N is one of a natural number N1 and a natural number N2, wherein the natural numbers N1 and N2 are greater than 1 and the natural number N1 is less than the natural number N2; and when the timer controller controls the display device to enter the three-dimensional display mode from the two-dimensional display mode, the method further comprises:

setting the natural number N to be the same as either one of the natural number N1 or the natural number N2 based on a refresh frequency of the three-dimensional display mode;

switching, by the timer controller, the display device from the two-dimensional display state to the three-dimensional display state, and reversing the polarity of the pixel electrode once every N number of frames for the left eye when the polarity reversal signal is output, wherein when the refresh frequency of the three-dimensional display mode is less than or equal to a predetermined threshold, the natural number N is set as the natural number N1, and when the refresh frequency of the three-dimensional display mode is greater than the predetermined threshold, the natural number N is set as the natural number N2; and switching, by the timer controller, the display device from the three-dimensional display state to the two-dimensional display state, and reversing the polarity of the pixel electrode once every frame when the polarity reversal signal is output when the timer controller causes the display device to enter the two-dimensional display mode from the three-dimensional display mode.

7. A display device, comprising:

a display controller configured to drive the display device, wherein the display controller is adapted to:

preset natural numbers N and M that are greater than 1, wherein the natural numbers N and M are different from each other; and a timer controller adapted to:

switch the display device from a two-dimensional display state to a three-dimensional display state when the timer controller causes the display device to enter a three-dimensional display mode from a two-dimensional display mode;

reverse a polarity of a pixel electrode once every N number of frames for a left eye and reverse a polarity of a pixel electrode once every M number of frames for a right eye during the three-dimensional display mode when a polarity reversal signal is output;

divide pixel units of a display panel into groups of pixel units, each of the groups of pixel units having three rows of serially arrayed pixel units;

driving two adjacent rows of pixel units of the three rows of serially arrayed pixel units by driving voltages with a same polarity;

driving a first subpixel at a first position and a second subpixel at a second position of a same pixel unit by driving voltages with opposite polarities; and driving a third subpixel of a first pixel unit and a fourth subpixel of a second pixel unit, respectively, by driving voltages with different voltage grades, wherein the first pixel unit and the second pixel unit are arranged adjacent to each other in the display panel.

8. The display device according to claim 7, wherein the natural numbers N and M are continuously changed within a preset range.

9. The display device according to claim 8, wherein the natural number N is between 2 to 6.

10. The display device according to claim 7, wherein the natural number N is adjusted according to a warming state of the display device.

11. The display device according to claim 7, wherein the timer controller is further adapted to cause the display device to switch from the three-dimensional display state to the two-dimensional display state and reverse the polarity of the pixel electrode once every frame when a polarity reversal signal is output.

12. The display device according to claim 7, wherein the natural number N is one of a natural number N1 and a natural number N2, wherein the natural numbers N1 and N2 are greater than 1, and N1 is less than N2, wherein when the timer controller controls the display device to enter the three-dimensional display mode from the two-dimensional display mode, the natural number N1 or the natural number N2 is set as the natural number N based on a refresh frequency of the three-dimensional display mode, wherein the timer controller switches the display device from the two-dimensional display state to the three-dimensional display state, and reverses the polarity of the pixel electrode once every N number of frames for the left eye when the polarity reversal signal is output, wherein when the refresh frequency of the three-dimensional display mode is less than or equal to a predetermined threshold, the natural number N1 is set as the natural number N, and when the refresh frequency of the three-dimensional display mode is greater than the predetermined threshold, the natural number N2 is set as the natural number N, and wherein when the timer controller controls the display device to enter the two-dimensional display mode from the three-dimensional display mode, the timer controller switches the display device from the three-dimensional display state to the two-dimensional display state and reverses the polarity of the pixel electrode once every frame when the polarity reversal signal is output.

13. A computer program product comprising a non-transitory computer-readable storage medium storing a computer program which, when executed by a processor of a display device, causes the processor to:

preset natural numbers N and M that are greater than 1, wherein natural numbers N and M are different from each other;

switch, by a timer controller, the display device from a two-dimensional display state to a three-dimensional display state when the timer controller causes the display device to enter a three-dimensional display mode from a two-dimensional display mode;

reverse a polarity of a pixel electrode once every N number of frames for a left eye and reverse a polarity of a pixel electrode once every M number of frames for a right eye during the three-dimensional display mode when a polarity reversal signal is output;

divide pixel units of a display panel into groups of pixel units, each of the groups of pixel units having three rows of serially arrayed pixel units;

drive two adjacent rows of pixel units of the three rows of serially arrayed pixel units by driving voltages with a same polarity;

drive a first subpixel at a first position and a second subpixel at a second position of a same pixel unit by driving voltages with opposite polarities; and driving a third subpixel of a first pixel unit and a fourth subpixel of a second pixel unit, respectively, by driving voltages with different voltage grades, wherein the first and second pixel units are arranged adjacent to each other in the display panel.

14. The computer program product according to claim 13, wherein the natural numbers N and M are continuously changed within a preset range.

15. The computer program product according to claim 13, wherein natural number N is adjusted according to a warming state of the display device.

16. The computer program product according to claim 13, wherein the computer program when executed by the processor further causes the processor to:

switch, by the timer controller, the display device from the three-dimensional display state to the two-dimensional display state and reverse the polarity of the pixel electrode once every frame when a polarity reversal signal is output when the timer controller causes the display device to enter the two-dimensional display mode from the three-dimensional display mode.

17. The computer program product according to claim 13, wherein N is one of a natural number N1 and a natural number N2, wherein the natural number N1 and N2 are greater than 1, and the natural number N1 is less than the natural number N2; and the computer program when executed by the processor further causes the processor to:

when the timer controller controls the display device to enter the three-dimensional display mode from the two-dimensional display mode, set the natural number N1 or the natural number N2 as the natural number N based on a refresh frequency of the three-dimensional display mode, switch, by the timer controller, the display device from the two-dimensional display state to the three-dimensional display state, and reversing the polarity of the pixel electrode once every N frames for the left eye when the polarity reversal signal is output, wherein when the refresh frequency of the three-dimensional display mode is less than or equal to a predetermined threshold, the natural number N1 is set as the natural number N, and when the refresh frequency of the three-dimensional display mode is greater than the predetermined threshold, the natural number N2 is set as the natural number N;

and when the timer controller controls the display device to enter the two-dimensional display mode from the three-dimensional display mode, switch, by the timer controller, the display device from the three-dimensional display state to the two-dimensional display state and reversing the polarity of the pixel electrode once every frame when the polarity reversal signal is output.

* * * * *